US006343653B1

(12) United States Patent
Mason et al.

(10) Patent No.: US 6,343,653 B1
(45) Date of Patent: Feb. 5, 2002

(54) CHEMICAL INJECTOR APPARATUS AND METHOD FOR OIL WELL TREATMENT

(76) Inventors: John Y. Mason, 2642 Marco Ave., Odessa, TX (US) 79762; Dorman N Matchim, 2813 Club Dr., Rocklin, CA (US) 95765; Micah L Knippers, Rte. 1 Box 210, Tenn. Colony, TX (US) 75861; Gary W. Douglas, 3917 Lyndale, Odessa, TX (US) 79762

( * ) Notice: Subject to any disclaimer, the term of this patent is extended or adjusted under 35 U.S.C. 154(b) by 0 days.

(21) Appl. No.: 09/384,887

(22) Filed: Aug. 27, 1999

(51) Int. Cl.[7] ..... E21B 21/00; E21B 31/00; E21B 43/00

(52) U.S. Cl. ..... 166/312; 166/90.1; 166/310

(58) Field of Search ..... 166/68, 90.1, 75.12, 166/105, 310, 312

(56) References Cited

U.S. PATENT DOCUMENTS

| | | | | | |
|---|---|---|---|---|---|
| 3,710,867 | A | * | 1/1973 | Bansbach | 166/244.1 |
| 3,899,027 | A | * | 8/1975 | Jenkins | 166/302 |
| 4,247,531 | A | | 1/1981 | Hicks | 423/477 |
| 4,333,833 | A | * | 6/1982 | Longley et al. | 210/190.1 |
| 4,590,057 | A | | 5/1986 | Hicks | 423/477 |
| 5,103,914 | A | * | 4/1992 | LaHaye | 166/310 |
| 5,147,530 | A | * | 9/1992 | Chandler et al. | 210/90 |

OTHER PUBLICATIONS

Photographs of Commercially Available Chemical Injector (Undated).

* cited by examiner

*Primary Examiner*—David Bagnell
*Assistant Examiner*—Jennifer R. Dougherty
(74) *Attorney, Agent, or Firm*—R. L. Graham

(57) ABSTRACT

An apparatus for injecting a treatment chemical into an oil well produced using a subsurface pump, preferably a subsurface rotary pump, is described. Crude oil is pumped upward from a subsurface oil production zone through a central production pipe in the well. A small portion of produced fluid is diverted through a by-pass line interconnecting the production pipe and the annular space of the well between the production pipe and the well casing. A venturi nozzle comprising a throat of reduced diameter is mounted in the by-pass pipe. A suction pipe interconnects a chemical storage container containing a treatment chemical with the nozzle throat. Under the action of the venturi nozzle a suction pressure is created in the nozzle throat whereby the treatment chemical is drawn through the suction pipe and mixes with the fluid in the by-pass line thereby delivering the chemical to the well annulus. The chemical flows down the annulus under the action of gravity, mixes with the fluid in the well, and is drawn into the production pipe at the pump inlet thereby treating the fluid in the well.

10 Claims, 2 Drawing Sheets

CHEMICAL INJECTOR APPARATUS AND METHOD FOR OIL WELL TREATMENT

BACKGROUND

This invention relates to an apparatus for injecting treatment chemicals into an oil producing well. In one aspect it relates to an apparatus that can be used with a subsurface pump, preferably a subsurface rotary pump, used to pump the crude oil to the surface during, production. In another aspect it relates to an injector apparatus with no moving parts that may be used in lieu of a surface chemical pump.

In the production phase of an oil well, it is usually necessary to artificially lift the crude oil from its natural level in the wellbore to the wellhead. The two most common lift methods are to use either a surface pumping unit or a subsurface rotary pump. A familiar sight in the oil fields around the world is the horse head bobbin up and down on a conventional beam pumping unit (pump jack). This method of bringing oil to the surface accounts for between 70% to 80% of the artificial lifting of oil. The pumping unit may be powered by either an electric motor or an internal combustion engine. In either case it is usually necessary to couple the motor and pump through a speed reducer. A reduction of 30 to 1 is typically needed to operate the pump at 20 strokes per minute (spm). The rotation of the prime mover is converted into an up-and-down motion of the beam and horse head through a pitman/crank assembly. The oscillating horse head of the pumping unit raises and lowers a sucker rod and reciprocates the sucker rod pump in the wellbore. This action lifts the oil on the upstroke to the wellhead. Because these pumps operate at low speed the average pumping rate in barrels per day (B/D) tends to be relatively low. However, the flow rate on the upstroke is much higher than the average rate, and in many instances can be sufficient for purposes of the present invention.

An electrically-powered subsurface pump consists essentially of a rotary centrifugal pump with the shaft directly coupled to an electric motor. The entire unit is cylindrical and is sized to fit inside the well casing. It is connected to the well tubing (i.e. central flow line) and has an insulated electrical cable attached to the outside of the tubing. The submersible equipment and cable are lowered into the well as the tubing is being un in on the surface. The pressure created by the rotation of the pump's impellers forces the fluid to the surface through the tubing. Because the pump runs at the same speed as the motor, submersible electrical pumps are capable of pumping larger volumes of fluids than conventional surface beam pumping units. For this reason, submersible pumps are often used where the oil-to-water ratio is high. A typical submersible rotary pump may lift from 250 to 26,000 B/D depending on the size of the casing and the depth of the well.

During production it is often necessary to inject a treatment chemical into the annular space between the well casing and tubing. These might include demulsifiers, corrosion inhibitors, scale inhibitors, paraffin inhibitors, etc. Demulsifiers are chemicals used to dehydrate crude oil containing emulsified water. In many cases this water-in-oil emulsion is very stable. Without the use of a demulsifier, the water would not separate from the crude oil. The rapid separation of the water from the oil phase may be necessary at the well site because of limited storage capacity. The combined total of water remaining in the crude oil must be below 1% in most cases. Excess water can cause serious corrosion problems in pipelines and storage tanks. In addition, water in a refinery stream can interfere with the distillation process and damage the refinery equipment.

In wells which use a production pumping unit, a small chemical pump may be used to inject the treatment chemical into the wellhead. The chemical pump may be powered by the same up-and-down movement of the pumping unit using a connecting rod. Several types of chemical pumps are known in the art. Although these mechanically actuated pumps are widely used they nevertheless present problems due to mechanical failure and plugging In a well using a submersible rotary pump, generally the only source of power at the surface is electrical. Using an electrically powered chemical surface pump has been found to be uneconomical because of the cost of transformers and other electrical equipment required to power the pump.

SUMMARY OF THE INVENTION

The present invention provides an apparatus for injecting treatment chemicals into an oil well. The injector apparatus is particularly adapted for use in wells being produced using a submersible rotary pump, but can also be used with reciprocating sucker-rod pumps. The present injector may be used in lieu of an electrical or mechanical surface chemical pump. The apparatus requires no power input and therefore is economical to operate. Because the apparatus has no moving parts it is reliable and easy to maintain.

The present apparatus uses a venturi flow nozzle to create a vacuum pressure source in a pipe to draw (suck) a treatment chemical from a chemical storage tank into the pipe. The pipe is connected to the wellhead and the chemical flows into the annular space between the well casing and the tubing for treating the well.

A submersible pump located near the bottom of the well draws fluid (crude oil) from the annular space between the casino and tubing and lifts the fluid through the tubing to the wellhead. At the wellhead a flow line conducts the produced fluid to a separation vessel storage tank or other collection means. The injector apparatus of the present invention is mounted in a small pipe or tubing (side stream or by-pass line) which interconnects the wellhead and the annulus. Thus a portion of the produced fluid is collected as in usual production, and a portion flows into the injector. The injector apparatus comprises a venturi nozzle having a throat of reduced flow area. Basic physics requires that the produced fluid flowing into the nozzle accelerate in the throat thereby increasing the kinetic energy of the flow. The increase in kinetic energy comes at the expense of the pressure energy (also called flow energy) and as a result the pressure in the throat decreases and a suction pressure is created in the nozzle. A flow line interconnects the throat of the venturi with a storage tank containing a treatment chemical to be injected into the well. Because the pressure in the throat is less than in the tank, the chemical flows from the tank into the nozzle and mixes with the fluid in the by-pass line and discharges into the annulus. The amount of chemical injected into the annulus may be adjusted by controlling the flow rate of fluid in the by-pass line. The flow rate of chemical in the line interconnecting the injector apparatus and the chemical storage tank is controlled with adjustable valves.

The submersible pump located near the bottom of the well operates continuously and acts to mix the fluid in the well annulus and tubing whereby the injected chemical is dispersed throughout the fluid in the entire well thereby treating the well. The flow rate of chemical into the well is controlled using adjustable valves in the injector apparatus. A wide range of flow rates are possible depending on the production flow rate of produced fluid.

DESCRIPTION OF THE PREFERRED EMBODIMENTS

A general description of a typical submersible pump installation will be given followed by the present chemical treatment injector apparatus. The term crude oil refers to produced fluids and may include from 0 to 100% water.

Submersible Rotary Pump

Figure 1:
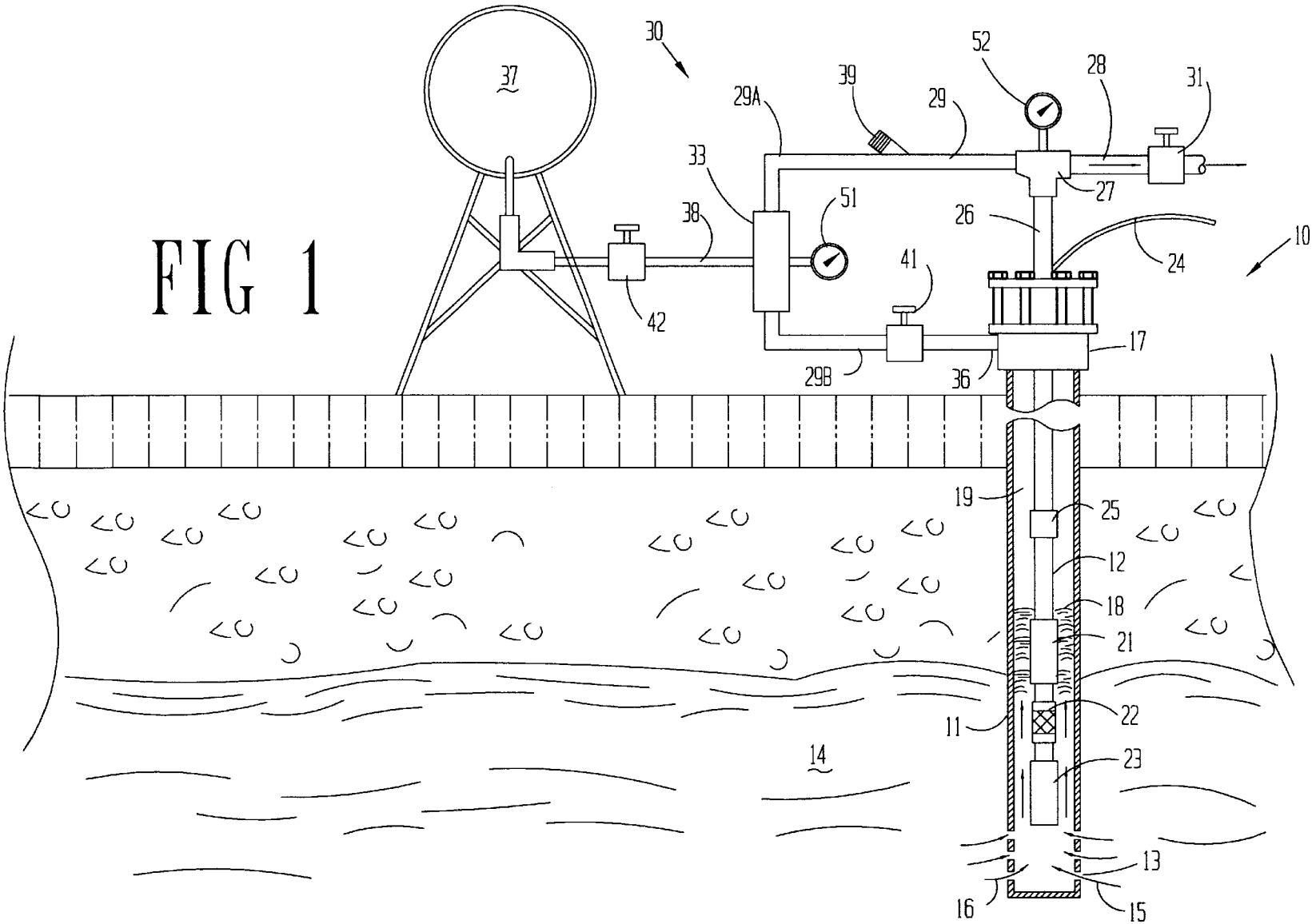
FIG. 1 is a schematic of the present injector in use with a submersible rotary pump.

With reference to FIG. 1, oil well 10 comprises casing 11 and production pipe 12 disposed within the casing. Casing 11 has perforations 13 at the bottom end located in oil production zone 14 to allow crude oil to enter the well through the perforations as illustrated by arrows 16. At the top end the well is sealed by wellhead 17 secured to casing 11. The fluid in the well raises to a natural level illustrated at 18 within annulus 19 between casing 11 and production tubing 12.

Open hole completions are also common. In open hole completions, the casing is completed above the production zone. Fluid from the production zone 14 flow uniformly into the wellbore 15.

Secured to the bottom of tubing 12 is pump 21, pump inlet filter 22, and electric motor 23 coupled to the drive shaft of pump 21 (not shown). Electric cable 24 provides power to motor 23 and pump 21. As illustrated pump 21, inlet 22, and motor 23 are submerged below the fluid level 18 in annulus 19. Pump 21 raises the pressure of the crude oil sufficiently to pump the oil through production pipe 12 to wellhead 17 and out wellhead discharge tubing 26. Crude oil thus flows through perforations 13, around motor 23, into pump inlet filter 22, into pump 21, through pipe 12, and out discharge line 26. The preferred type of pump 21 is a centrifugal pump. Check valve 25 may also be positioned downstream of pump 21 to limit the flow to one direction only. The above discussion is by way of illustration only and not intended to limit the scope of the present invention. Submersible, electrically driven pumps are commercially available from several sources(e.g. REDA, ESP). Other submersible pump configurations are possible for use with the present chemical injector apparatus including pneumatically or hydraulically driven pumps.

Discharge line 26 is connected to flow line 28 through tee 27 into line 28. Line 28 is the production line and flows to a storage tank or other collection means. A small by-pass line 29 is connected to tee 27 and contains portions of the present injector apparatus as described below. Choke valve 31 in line 28 may be opened or closed to adjust the relative flow rates in lines 28 and 29, and control the pressure upstream of the venturi nozzle 33 of the injector system. The flow rate through by-pass line 29 is generally small compared to that of line 28 so the majority of the crude oil at the wellhead is produced through line 28.

Chemical Injector

Chemical injector 30 comprises inlet by-pass flow line 29A connected to venturi nozzle 33, and by-pass outlet 29B interconnecting the outlet of nozzle 33 and wellhead 17 as at 36. Apparatus 30 further comprises chemical storage tank 37 connected to venturi 33 through suction line 38. Strainer 39 may be disposed within line 29A to remove solids in the crude oil that might plug or damage venturi 33. Adjustable valves 41 and 42 are disposed in lines 29B and 38, respectively, to control the flow rates therein. Lines 29A, 29B, 38, and 53 (see FIG. 2) may be connected to venturi nozzle using conventional threaded pipe fittings (not shown).

Figures 2, 3:
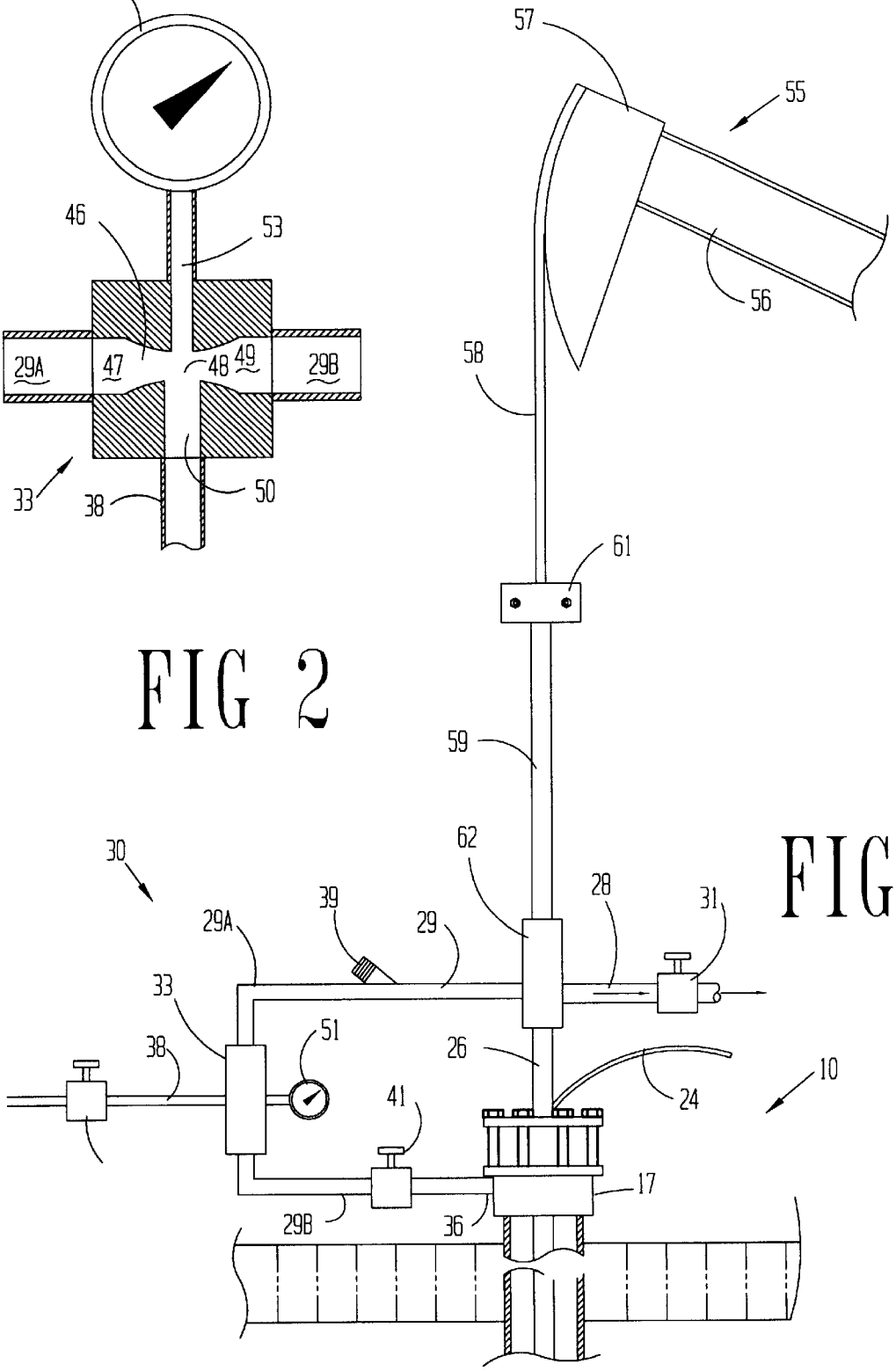
FIG. 2 is a sectional view of the venturi nozzle of the present injector apparatus.
FIG. 3 is a schematic of the present injector in use with a reciprocating pump.

As seen in FIG. 2, venturi nozzle 33 comprises a central flow passage 46 comprising inlet 47 and throat 48. The diameter of inlet 47 may be substantially the same as the internal diameter of line 29 providing a smooth transition therebetween. The internal walls of nozzle are inwardly tapered leading to throat 48 which is the point of minimum flow are in the nozzle. The principle of conservation of mass requires the following equation to be satisfied $$A_t V_t = A_i V_i \tag{1}$$

where:

$A_t$=flow area of the nozzle throat=$\pi d_t^2/4$ $V_t$=fluid velocity at the throat $A_i$=flow area of the nozzle inlet=$\pi d_i^2/4$ $V_i$=fluid velocity at the inlet Thus the throat velocity may be written in terms of the diameters of the throat and inlet and the inlet velocity as follows $$V_t = V_i(d_i^2/d_t^2) \tag{2}$$

It can be seen in Equation (2) that the fluid velocity at the nozzle throat will be larger than the inlet velocity by a factor of the ratio of squares of the inlet and throat diameters. By way of example, if the inlet has a diameter four times that of the throat, the fluid velocity at the throat will be sixteen times greater than at the inlet.

The fluid has accelerated between the nozzle inlet and throat and, therefore, the kinetic energy of the fluid has increased. This increase has come at the expense of (since energy must be conserved) the pressure energy (sometimes also called the flow energy) and thus the pressure in the throat must be lower than at the inlet. This principle is expressed by the Bernoulli equation given by $$P_t/\rho + \tfrac{1}{2}V_t^2 = P_i/\rho + \tfrac{1}{2}V_i^2 \tag{3}$$

where:

$\rho$=fluid density $P_t$=fluid throat pressure $P_i$=fluid inlet pressure

Solving Equation (3) for the throat pressure yields $$P_t = P_i - \tfrac{1}{2}\rho[V_t^2 - V_i^2] \tag{4}$$

Since the difference in the velocities squared (terms in brackets on right hand side) will be positive by virtue of the discussion above, Equation (4) indicates that $P_t$ must be less than $P_i$. In the present apparatus the velocity in throat 48 is high enough relative to the inlet velocity to create a suction pressure (i.e. less than atmospheric pressure) in the throat.

Since the velocity of the fluid flow through the venturi nozzle is a function of inlet pressure, a minimum $P_i$ must be maintained to achieve the necessary suction the throat 48. This can be achieved by simply adjusting choke 31. An inlet pressure in the range of 10 to 500 psi should be adequate in most applications.

Downstream of throat 48, nozzle 33 has outwardly tapered surfaces terminating at discharge 49. Discharge 49 is of the same diameter as inlet 47 so that as the fluid flows from throat 48 to the discharge the above phenomenon is essentially reversed whereby the fluid decelerates and the pressure rises to the level of the pressure at inlet 47.

Throat 48 is connected to chemical storage tank 37 through suction line 38. The venturi housing may also comprise an internal passage 50 interconnecting line 38 and throat 48. The suction pressure in throat 48 is sufficient to draw treatment chemical from tank 37 into nozzle 33 through line 38. The flow rate of the chemical may be controlled by adjusting valve 42. The chemical mixes with the crude oil in the nozzle and is carried thereby to wellhead 17 through line 34. The crude oil/chemical mixture flows down annulus 19 under the action of gravity and mixes with the crude oil in the annulus. The chemical is dispersed through out the crude oil by agitation created by pump 21 and by natural diffusion of the chemical in the crude oil and thus the entire well, including fluid in the tubing, is chemically treated. Pressure gauges 51 and 52 may be installed to monitor the pressure in at the wellhead 17 and throat 48, respectively, and assist in setting the proper operating positions of valves 41 and 42, as well as choke 31.

Apparatus 30 has essentially no moving parts and is therefore reliable and inexpensive to maintain. In addition the apparatus requires no power input and is therefore economical to operate.

The dimensions of apparatus 30 in relation to well 10 are not intended to be in proportion in FIG. 1 as apparatus 30 has been shown enlarged to illustrate the salient features of the apparatus.

Subsurface Rod Pump

The present injector apparatus may be also be used with a subsurface reciprocating rod pumping unit. Referring the FIG. 3, pumping unit 55 comprises beam horse head 57 connected to beam 56 which is reciprocated upward and downward using pitman crank mechanism usually powered by an electrical motor or an internal combustion engine. Connected to horse head 57 is flexible cable 58 which in turn is connected to steel polished rod 59 using bridle 61. Polished rod 59 extends into the well bore through stuffing box 62 which contains packing to provide a fluid seal around polished rod 59. Box 62 also has outlets for feeding produced fluids to lines 28 and 29. Alternatively, stuffing box 62 may have a single outlet with a Y-fitting attached thereto for separating the flow into lines 28 and 29. Within the well bore polished rod 59 is connected to a sucker rod (not shown) which acts as the pump. Thus horse head 57, cable 58, polished rod 59, and the sucker reciprocate upward and downward as a unit. During the downward stroke, fluid in the well flows into the pump while on the upward stroke, the fluid is pumped to the well head and is produced. Thus, the production of fluid in the reciprocating pump is intermittent with each upstroke of the pump. During the upstroke, a portion of the produced fluid flows through line 29 and into injector nozzle 33 wherein the suction created by the fluid flow draws treatment chemical into the nozzle through line 38. The treated fluid flows through line 29B and into the well at 36. Thus the introduction of treating chemical into the well is accomplished by the intermittent flow created by pumping unit 55. The majority of the produced fluid flows through line 28 for collection. The speed of the pump is typically between 2 to 20 strokes per minute depending on the well size. Several embodiments of the rod pumps are widely used in the oil industry as understood by those skilled in the art. See for example, *Modern Petroleum,* PennWell Publishing Co., Tulsa, Okla., the disclosure of which is incorporated herein by reference.

Operation

The injector apparatus of the present invention may be retrofitted on existing wells produced by submersible rotary pumps by simply (a) installing the by-pass line 29 including components 33,39, and 41 as illustrated in FIG. 1, and (b) providing the chemical tank 37 and line 38. The by-pass line may ¼" to 1" pipe or tubing, which is small relative to flow lines 26 and 28. During operation, choke 31, valves 41 and 42 may be adjusted to provide the desired flow rate of chemical injection into annulus 19.

The rate of chemical injection will depend on several factors including type of chemical, severity of conditions being treated, economics, etc. The chemical in the chemical tank 37 is generally present in a solvent so the fluid stream entering the by-pass line from the tank may be only 10 to 50% active.

The concentration of the chemical entering the by-pass stream will depend on several factors, but generally will be between 1 to 10,000 ppm. Examples of treatments are as follows:

| | |
|---|---|
| Corrosion Inhibitor | 1 to 1000 ppm active |
| Demulsifier | 20 to 2000 ppm active |
| Scale Inhibitor | 3 to 300 ppm active |
| Wax Inhibitor | 20 to 2500 ppm active |

The flow rate of the fluids through the by-pass line will generally be only 0.1 to 10% of the fluid produced, preferably between 1 to 6%. It is contemplated that the GPM of flow through the by-pass line will be between 0.5 to 2, preferably between 1 and 1.5 for most operations.

The relatively small rate of fluid flow in the by-pass line enters the annulus at 36 and gravity causes the fluid to flow down the annulus where it mixes with the well fluids at level 18. The treatment chemical mixes with the well fluids prior to entering, pump suction 22.

During the production, as may come out of solution between the pump inlet and the wellhead. This, however, should not adversely affect the overall operation of the injector system.

Although the present invention has been described with specific reference to electrically driven pumps, it will be recognized by those skilled in the art that it can be used with any rotary submersible pump (e.g. hydraulic) or alternatively with a reciprocating sucker-rod pump. The present injector system may also be used to treat water wells produced by a submersible pump. The term submersible pump refers to both rotary pumps and reciprocating sucker-rod pumps.

What is claimed is:

1. An apparatus for injecting a chemical into an oil well producing fluids including oil and gas from a subsurface formation, said well having a casing extending to or near the subsurface formation, a wellhead mounted on said casing, a production pipe extending through the wellhead and through at least a portion of the casing defining therewith an annulus, and a subsurface pump positioned at or near the lower end of the production pipe, said apparatus comprising:

(a) a by-pass line interconnecting the production pipe and annulus, (b) a venturi nozzle mounted in the by-pass line and having an inlet and a throat, said throat having a smaller diameter than said inlet, (c) a storage container containing an oil well treatment chemical, and (d) a pipe interconnecting the storage container and the throat of the venturi nozzle whereby a portion of the fluid produced by the subsurface pump flows through the production pipe, the by-pass line, and into the well annulus thereby drawing the oil treatment chemical from the storage container into the by-pass line by action of the venturi nozzle.

2. The apparatus of claim 1 wherein the pump is a submersible rotary pump mounted on the lower end of the production pipe.

3. The apparatus of claim 2 wherein the submersible rotary pump is electrically powered.

4. The apparatus of claim 2 wherein the submersible rotary pump is hydraulically powered.

5. The apparatus of claim 1 wherein the pump is a reciprocating pump.

6. The apparatus of claim 1 wherein the treatment chemical is selected from the group consisting of corrosion inhibitors, demulsifiers, scale inhibitors, and wax inhibitors.

7. The apparatus of claim 1 wherein the treatment chemical which is drawn into the by-pass line is in a solvent having a concentration of between 1 to 10,000 ppm of the treatment chemical.

8. The apparatus of claim 1 wherein the flow of fluids in the by-pass line is between 0.1 to 10% of the total flow produced from the well.

9. The apparatus of claim 1 wherein the pressure at the inlet of the venturi nozzle is between about 10 to 500 psi.

10. A method of treating subsurface oil well with a treating chemical, said well having a production pipe and a casing which define an annulus, said method comprising:

(a) interconnecting at the surface the production pipe and annulus with a by-pass line which includes (i) a venturi nozzle mounted in the by-pass line and (ii) a chemical container connected to the venturi nozzle, said container containing a well-treating chemical;

(b) flowing oil well fluids through the production pipe, said fluids including oil and gas; and (c) at the surface diverting continuously from 0.1 to 10% of the oil well fluids through the by-pass line, the surface pressure of the fluids from the well entering the by-pass line being sufficient to produce sufficient fluid flow through the venturi nozzle to suck the treating chemical into the fluids flowing through the by-pass line and provide a treating chemical concentration therein of between 1 and 10,000 ppm; and (d) returning the fluids flowing through the by-pass line with the treating chemical to the well annulus, whereby the fluids with the treating chemical mixes with well fluids produced through a subsurface pump.

* * * * *